US006575467B1

(12) United States Patent
Kal

(10) Patent No.: US 6,575,467 B1
(45) Date of Patent: Jun. 10, 2003

(54) MULTI-STAGED POKER GAME AND METHOD OF PLAYING GAME WITH CHANGING WILDCARDS, WINNING HANDS OF CARDS AND PAYOUT ODDS AT EACH STAGE

(76) Inventor: Stephen F. Kal, 3291 S. Fulton Ct., Denver, CO (US) 80231

( * ) Notice: Subject to any disclaimer, the term of this patent is extended or adjusted under 35 U.S.C. 154(b) by 0 days.

(21) Appl. No.: 10/056,741

(22) Filed: Jan. 25, 2002

(51) Int. Cl.[7] ..... A63F 1/00

(52) U.S. Cl. ..... 273/292; 273/274; 273/309; 463/13; 463/26; 463/27; 463/28

(58) Field of Search ..... 273/292, 274, 273/309; 463/13, 26, 27, 28

(56) References Cited

U.S. PATENT DOCUMENTS

| | | | | |
|---|---|---|---|---|
| 5,167,413 A | | 12/1992 | Fulton | |
| 5,251,897 A | | 10/1993 | Fulton | |
| 5,288,081 A | | 2/1994 | Breeding | |
| 5,411,257 A | | 5/1995 | Fulton | |
| 5,437,462 A | | 8/1995 | Breeding | |
| 5,820,460 A | | 10/1998 | Fulton | |
| 5,851,011 A | * | 12/1998 | Lott | 273/292 |
| 6,206,373 B1 | * | 3/2001 | Garrod | 273/292 |
| 6,206,780 B1 | * | 3/2001 | Awada | 463/13 |
| 6,237,916 B1 | * | 5/2001 | Webb | 273/292 |
| 6,273,424 B1 | | 8/2001 | Breeding | |
| 6,302,398 B1 | * | 10/2001 | Vecchio | 273/292 |
| 6,311,976 B1 | * | 11/2001 | Yoseloff et al. | 273/138.2 |
| 6,345,823 B1 | * | 2/2002 | Webb | 273/292 |

OTHER PUBLICATIONS

Webb et al.—Patent Application Publication No: US 2002/0153662 A1—Oct. 24, 2002.*

Hartl—Patent Application Publication No: US 2003/0008697 A1—Jan. 9, 2003.*

* cited by examiner

*Primary Examiner*—Benjamin H. Layno
*Assistant Examiner*—Dolores R. Collins
(74) *Attorney, Agent, or Firm*—John R. Ley

(57) ABSTRACT

Each round of a poker game is played in stages using a conventional deck of cards. A wager is placed at each stage, a hand of cards is dealt to each player at each stage, and the cards dealt to each player in previous stages become part of each players hand of cards at each subsequent stage. A different wildcard is designated at each stage. A winning hand of cards is determined and rewarded at each stage by comparing each players hand of cards including any wildcards to a schedule of winning card combinations and an odds schedule at each stage. At least some of the winning card combinations and some of the odds for each winning card combination are changed at each stage.

29 Claims, 6 Drawing Sheets

MULTI-STAGED POKER GAME AND METHOD OF PLAYING GAME WITH CHANGING WILDCARDS, WINNING HANDS OF CARDS AND PAYOUT ODDS AT EACH STAGE

This invention relates to a poker game, and more particularly to a new and improved stud poker game which is played in multiple stages, with a changing wildcard, changing winning hands, and different payout odd at each of the stages, all of which simultaneously increases the competition for more serious players while decreasing the complexity for casual players seeking primarily entertainment.

BACKGROUND OF THE INVENTION

With the ever-increasing number of casinos and commercial gaming facilities, more people have started gambling. The people who gamble at casinos are generally of two types. One type of gambler is the serious, intentional individual who plays the game primarily for competitive, compensatory, excitement and even professional reasons. The other type of gambler is casually seeking primarily entertainment as a result of participating in the game and being in a high-activity environment of a casino. Serious gamblers expect the game to offer a competitive challenge and payout opportunity. More challenging games with higher payout opportunities generally involve relatively higher levels of complexity and, therefore, require more mental concentration and knowledge of the game. The casual player seeking entertainment usually does not wish to commit a high level of concentration and mental activity to the game.

It is important for casinos and other professional gaming facilities to offer games that are attractive to the serious, intentional player as well as the casual player. The casino provides the games environment and the entertainment solely for commercial purposes. The gaming environment and some entertainment is usually offered at no cost. The income to a casino is derived from the odds which favor the casino or house in each of the gambling games. The odds for many gambling games are often fixed by law, business practice or convention, so the income derived by a casino is directly related to the number of players which the casino attracts, and the ability of the casino to maintain patron involvement in actual gambling. In order to maximize the profit generated, it is desirable to attract a large number of players and to keep the players gambling for an extended period of time. A casino is most likely to make a profit from a player who plays a single game longer because it is unlikely that such a player will be able to beat the house odds over an extended period of play.

Casinos have attempted to attract players and keep them involved in gaming by offering the extra or added incentive of a relatively non-complex auxiliary or sideline game which is played simultaneously with the more complex primary gambling game, but which does not interfere with the play of the primary game. The pace and complexity of the auxiliary game is much slower and more entertaining than the pace of the primary game. The more serious player need not participate in the auxiliary game. The auxiliary game offers its own set of separate payouts which are more of entertainment value compared to the more significant monetary payouts and risks from the primary game. For example, many auxiliary games may award bonus points as payouts. Once a player has collected a predetermined number of bonus points, the player is awarded a prize or gift. In this manner, the auxiliary or sideline game offers entertainment opportunities, which serious players may forego, but the disadvantage of the auxiliary or sideline game is that the player must also participate in the more demanding, complex and risky primary game.

Poker games have also been devised to break up a single round of play into different events which move toward completion of the single round of play. For example, a first number of cards are dealt to a player. The number of cards initially dealt in this first event are less than all of the cards required to complete the round of play. After receiving the initial cards, the player has the option of continuing play or withdrawing. Withdrawing allows the player to reclaim some but not all of the initial wager. There is no opportunity to win after the first event, because the winner is determined by completing the entire round. Therefore, the player has no possibility of winning anything unless the player wins the entire first round. Moreover, this type of game is simply a division of a typical poker game which requires all of the concentration and effort as would be required for playing a conventional poker game. Another type of poker game allows the player to buy "insurance" at the beginning of each round of play. Buying insurance provides the player with an opportunity to win some type of compensation even if the player loses the round of play. Again, any rewards to a player who does not win the round of play are not based on the enjoyment and activity of the play itself, but are based on random events not involving the play of the game. It is again necessary to continue the entire round of play in order to obtain the possibility of payout from winning the round of play or an award as compensation for buying the insurance. These types of games do nothing to simplify the game itself or to increase the enjoyment to the casual player.

These and other considerations have been instrumental in giving rise to the present invention.

SUMMARY OF THE INVENTION

The present invention offers a single poker game and a single method of playing the game which have the effect of increasing the complexity and opportunities for serious, intentional competitive players who gamble more for reasons of competition and excitement, while simultaneously decreasing the amount of concentration and effort required from casual players seeking entertainment. The present invention divides the poker game into multiple stages, and offers gambling opportunities, payouts and entertainment value at each stage of a single round of the game. The multiple stages contribute interest, complexity and competition for each round which appeals to serious player, but the play within each of the stages is simplified sufficiently so that the casual player enjoys the game equally well. The result is increased interest, intrigue, challenge, complexity and entertainment value of a single poker game, which has the benefit of attracting more players of all types and keeping the players engaged in the play of the game for a longer time. The added interest of an auxiliary or sideline incentive game is also inherently obtained by the multiple stages of each round of the game, because each player retains a meaningful opportunity for a payout at each stage of a round of the game. The present invention also provides a casino or commercial gaming facility with the opportunity of extending the house odds and level of play within the context of a single, supervised and odds-controlled game, without using its facilities for an auxiliary or sideline game of little or no commercial value.

These and other aspects of the invention are obtained by a method of playing a round of a poker game using at least one deck of cards having different suits of cards within the deck and having different rankings of cards within each suit. Each round of the game is divided into a plurality of stages, and a wager is placed at each stage of the round. A hand of cards is dealt to each player at each stage, and part of the hand of cards dealt to each player in each subsequent stage is formed by the cards dealt to that player in each previous stage. A different wildcard is designated for each stage. Each player is determined to have a winning hand of cards at each stage by comparing the hand of cards including any wildcards held by each player to a schedule of winning card combinations applicable to that stage. Each winner is paid at each stage according to an odds schedule applicable to each hand of winning card combinations at each stage. At least some of the winning card combinations and at least some of the odds of the odds schedule for each winning card combination are changed at each stage.

The changing wildcards and odds at each stage of the round and the variation in winning hand card combinations at each stage appeal to serious, intentional, competitive players. On the other hand, the relative simplicity of determining the winning card combinations at each stage by using the schedule of winning card combinations and the wildcards at each stage decrease concentration and effort required from those casual players who play the game more for entertainment. The multiple stages of the game create interest, possibilities and entertainment for all players and make an auxiliary or sideline incentive game unnecessary. The multiple stages and odds at each stage extend the house odds and level of play within the context of a single, supervised and odds-controlled game, while increasing the commercial utilization of the facilities of the casino or gaming facility.

Other preferable aspects of the method of playing the game include designating as the wildcard, a card having a numerical ranking equal to the number of cards forming the hand of cards at each stage of each round. Preferably an odds schedule of greater than 1 to 1 for at least one of the winning hand card combinations is established at each stage.

Variations of playing the game include dealing at least one of the cards of each hand face-down and turning all cards face-up before dealing additional cards in a new hand in a subsequent stage. Each player may be required to ante an additional wager after dealing the cards at each stage face-down as a requirement for continued play within that stage and within the round. The additional wager anted by each player at each round are awarded to the player having the highest-ranking winning hand among all the players playing in that round, while each individual player at each stage is still paid according to his or her winning hand of card combinations according to the odds schedule. Other variations include dealing a community card during each stage which is part of all of the player's hands of cards for that stage, and dealing a hand of cards to a dealer at each stage. The dealer's hand of cards is required to achieve a predetermined minimal card combination value in order to continue play of the round beyond that stage, and each player is awarded a payment equal to the initial wager of the player if the dealer's hand of cards fails to achieve the minimal value.

The game is preferably played on a tabletop configuration comprising a card play portion for each player into which the player's hand of cards is dealt, a wagering portion including a wager enclosure for each stage of the round and within which each player places the wager for that stage of the round, and a payout portion containing a schedule of the winning hand card combinations and the payout odds for each winning hand card combination at that stage of the round. Preferably, the wager enclosure for each stage of the round is located adjacent to the indication of each wildcard for each stage of the round.

A more complete appreciation of the present invention and its scope may be obtained from the accompanying drawings, which are briefly summarized below, from the following detailed descriptions of presently preferred embodiments of the invention, and from the appended claims.

DETAILED DESCRIPTION

Figure 1:
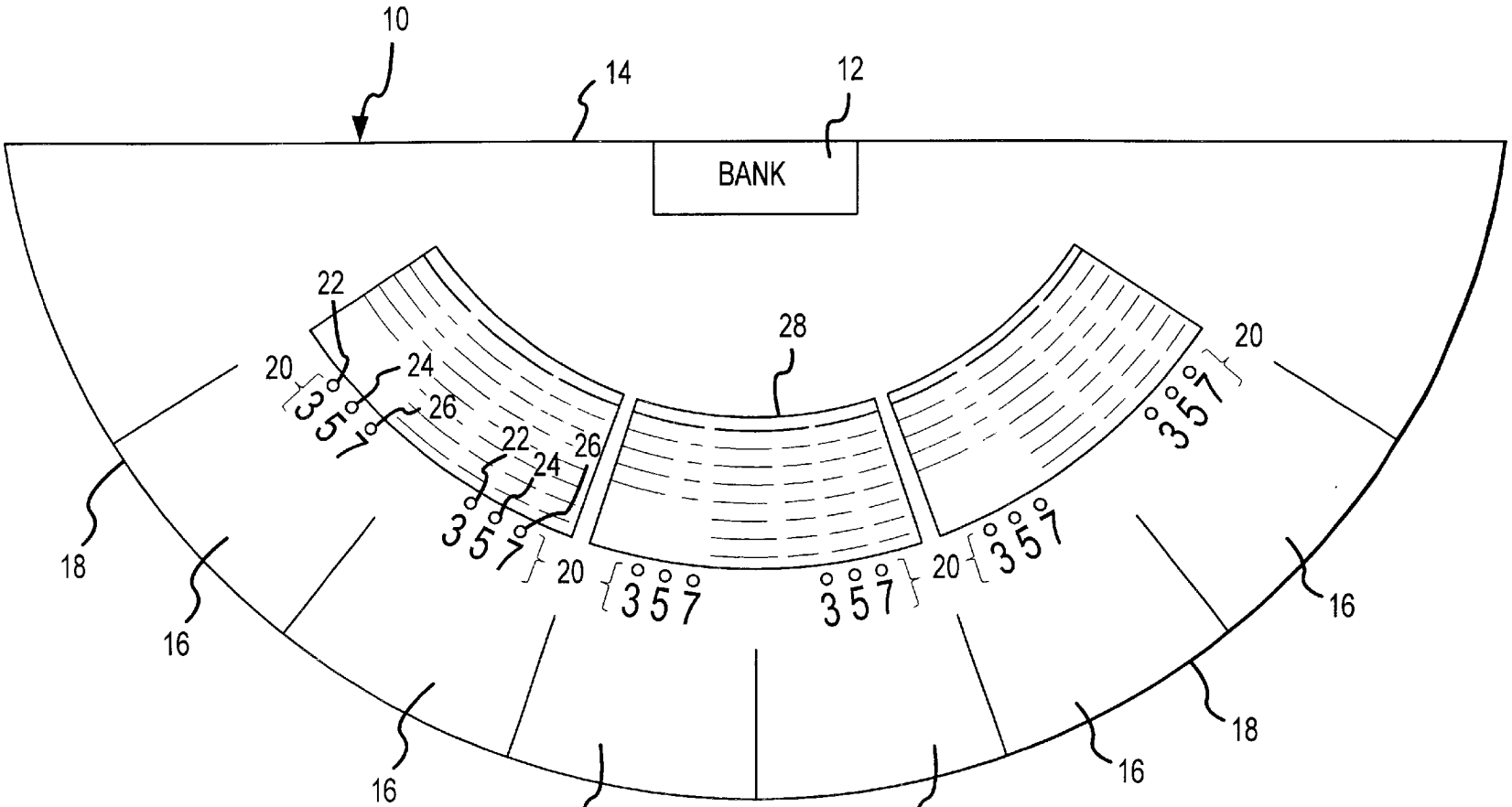
FIG. 1 is a plan view of a configuration for a table top of a typical gambling table, upon which to play the game of the present invention.

A layout, format or configuration 10 upon which to play a stud poker game which has multiple stages, with changing wildcards, winning hands and payout odds at each stage is shown in FIG. 1. The term "poker" is used here in its typical sense, meaning a card game or a stage of a card game played by two or more players who bet on the value of their hands of cards. The term "stud," used with reference to poker, means a type of play in which some of the cards are dealt face-up and some of the cards are dealt face-down during the course of the poker game or during a stage of the poker game, or where all of the cards may be dealt face-up or face-down during the course of the poker game or during a stage of the poker game, but does not include the situation where cards may be discarded from the hand dealt and the discarded cards replaced with new cards.

As shown in FIG. 1, the configuration 10 is formed generally in the semicircular shape typical of the table top of gaming tables used at casinos and commercial gambling facilities. As such, the configuration can be placed on the table top of such a gaming table. A "bank" portion 12 of the configuration 10 is located at the center of a straight side 14 of the semicircular shaped configuration 10. A number of circumferentially-spaced, sector-shaped card play portions 16 of the configuration 10 extend from a circular edge 18 inward toward the bank portion 12. A wagering portion 20 is located on the configuration 10 at an interior margin of each card play portion 16, between the card play portion 16 and the bank portion 12. Each wagering portion 20 includes three circular or other geometric shapes which define wager enclosures 22, 24 and 26 below which three numbers are printed. As shown in FIG. 1, the numbers three, five and seven are printed from left to right below each of the three wager enclosures 22, 24 and 26, respectively. A payout portion 28 of the configuration 10 is located between the wager enclosures 22, 24 and 26 and the bank portion 12. A textual indication or schedule of the type of winning hands of card combinations and the payout odds associated with each winning hand card combination at each stage of the game is included within each payout portion 28. The payout portion 28 is large enough that it encompasses two adjoining wagering portions 20 of the configuration 10.

The dealer stands or is positioned behind the bank portion 12. The dealer keeps the house chips on the bank portion 12. The dealer deals cards from a single deck or a multiple-deck "shoe" (not shown) which is normally placed on the configuration 10 at a location which does not impede the play of the game. The cards used are from a conventional deck having four suits of thirteen cards in each suit. The players stand, sit or are positioned on stools along the curved circular edge 18, in alignment with a card play portion 16 that a player uses to play the game. The player may keep his or her chips near the circular edge 18 within his or her card play portion 16. The dealer deals cards to each player and places them within the card play portion 16 that each player has chosen. Each player places a wager or bet within one or more of the wager enclosures 22, 24 and 26 at the beginning of each round of play, or at the beginning of each stage of the play of each round, depending upon the protocol selected for game play. The odds schedule printed in the payout portion 28 determines the multiplication factor for each player's payout relative to the amount of the wager made by each player in the wager enclosures 22, 24 and 26.

Figure 3:
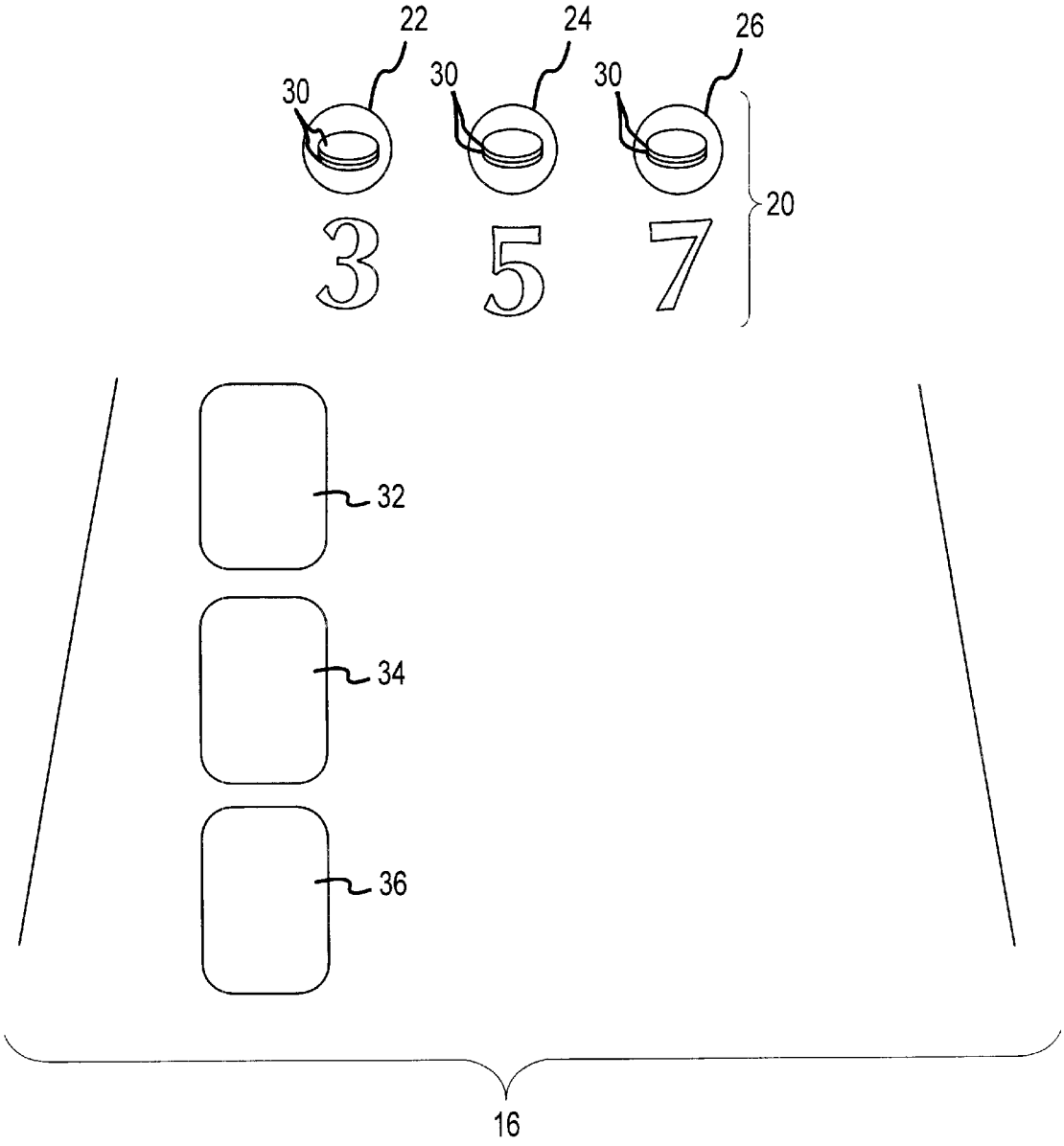
FIG. 3 is an enlarged plan view of a wagering and card play portion of the configuration shown in FIG. 1, also illustrating the play of cards during a first stage of playing a round of the game of the present invention.

Each round of play of the poker game is divided into multiple stages. In the preferred embodiment of the game described herein, there are three stages. However, the broader concept of the game is to incorporate any number of multiple stages. Prior to beginning play of each round of the game, each player is required to place a wager for each of the stages of that round. Each player places the wager for each stage of the round by placing a player-selected number of chips or other monetary value within each of the first, second and third wager enclosures 22, 24 and 26, as shown in FIG. 3. Preferably, the wagers for each stage must be equal, although the amount of the equal wager for each stage may be selected by the player. FIG. 3 illustrates the circumstance where two chips 30 have been wagered for the first, second and third stages of the round by placing them in the first wager enclosure 22, the second wager enclosure 24 and the third wager enclosure 26, respectively. Other variations of the game may allow each player to wager different amounts at each of the stages of the round.

By requiring each player to place his or her wagers for all stages of a complete round, before commencing that round, the maximum monetary value of the round is established. Requiring each player to wager for all stages of the game before commencing any stage of the round has the psychological effect of urging the player to complete the entire round through all of its stages. However, if a player chooses not to complete the round after playing the first stage or after playing the first and second stages of the game, the player may withdraw in the second and third stages of the game, respectively, and retrieve the wagers initially made for the remaining stages of the round. It may be also possible to play the game by requiring the player to make wagers with respect to each stage of the game before beginning that stage of the game, and not requiring the player to make wagers on subsequent stages which have yet to be played within that round.

Once all of the wagers in the wager enclosures 22, 24 and 26 have been placed, the first stage of play commences by the dealer dealing three cards 32, 34 and 36 to each player, as shown in FIG. 3. The three cards are dealt in each players card play portion 16 generally in alignment with the first wager enclosure 22 to indicate the cards played during the first stage of the round. Because the preferred form of the game is stud poker, preferably all three of the cards 32, 34 and 36 are dealt face-up. However, variations of play may permit at least one of the cards to be dealt face-down.

The printed number three below the wager enclosure 22 indicates the denomination of card that is wild in this first stage of the round of play. Thus, if one of the cards 32, 34 or 36 is a three, any value may be substituted for that card. Using any wildcards and the other cards which are not wildcards that have been dealt to each player in the first stage of the game, each player who receives one of the winning hands designated within the payout portion 28 (FIGS. 1 and 2) wins an amount established by his initial wager and the odds designated within the payout portion 28 for that winning hand of cards. Those players who did not receive one of the hands designated in the payout portion 28 lose their initial wager placed in the wager enclosure 22.

Figure 2:
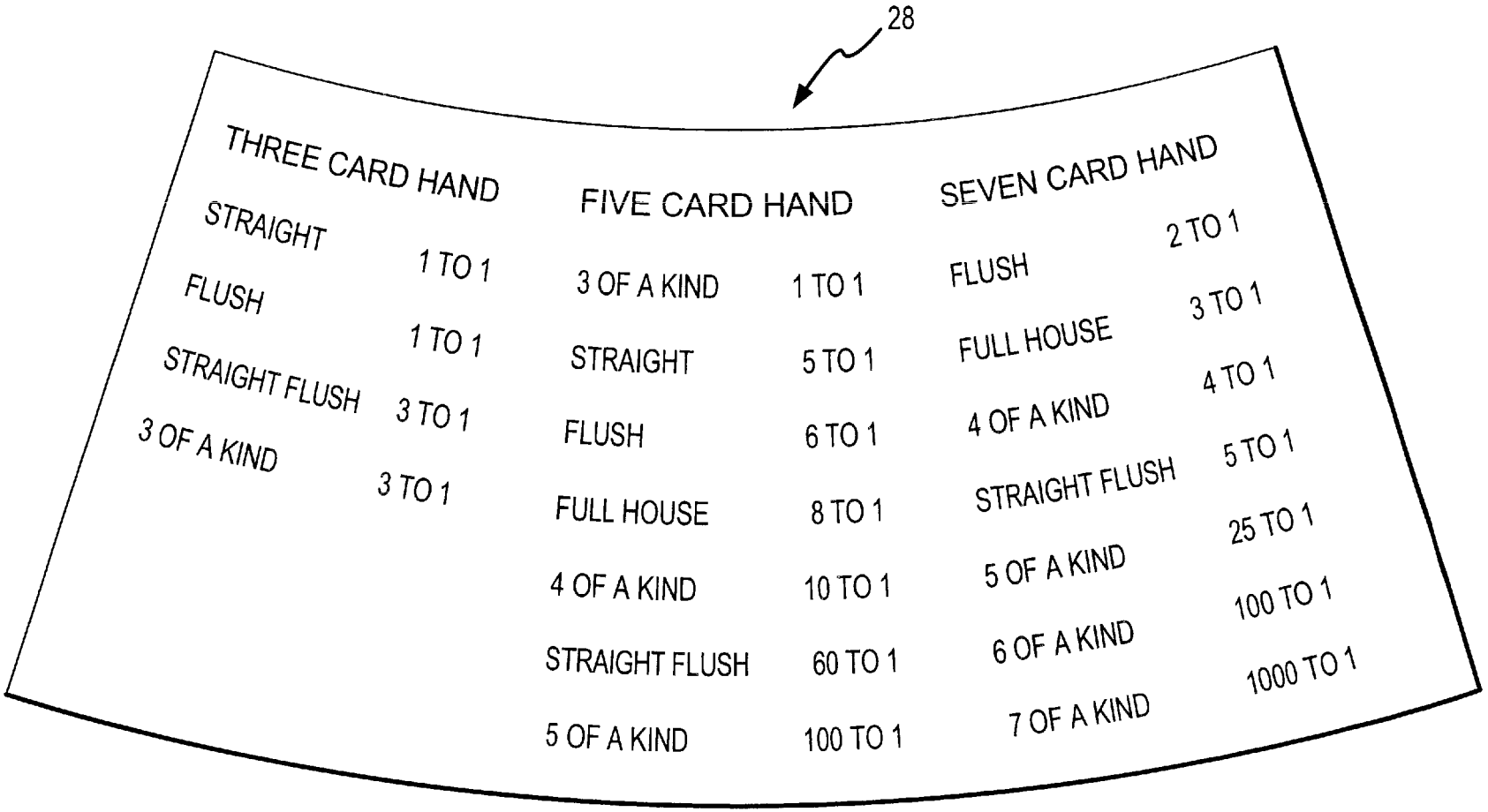
FIG. 2 is an enlarged plan view of a payout portion of the configuration shown in FIG. 1.

The payout portion 28 describes the winning hands of cards during each stage and the payout odds for each winning hand of cards, as shown in the payout portion 28 shown in FIG. 2. The payout portion 28 is divided into three column-like sections, titled from left to right (as shown) as "Three Card Hand," "Five Card Hand" and "Seven Card Hand." The "Three Card Hand" section of the payout portion 28 governs the play during the first stage of each round, with respect to the wagers placed in the first wager enclosure 22 (FIG. 3), during the first stage of each round when the three cards 32, 34 and 36 are dealt. The winning hands of three cards in the first stage of the round are a straight, a flush, a straight flush and three of a kind. The payout odds for a straight is 1 to 1, meaning that in addition to keeping the initial wager in the wager enclosure 22, the player also receives an amount from the bank or dealer which is equal to the amount of the wager placed in the first wager enclosure 22. The payout odds for a flush is also 1 to 1. The payout odds for a straight flush is 3 to 1, meaning that in addition to keeping the initial wager, the player receives an amount equal to three times the amount of the initial wager placed for the first stage of the round of play. The payout odds for three of a kind is also 3 to 1.

To determine winning hands, the cards of each suit of the deck are ranked in the following order from highest to lowest: ace, king, queen, jack, ten, nine, eight, seven, six, five, four, three and two. The ace card can also be used as the lowest ranking card in a straight. Of course, a wildcard can be used as a substitute for any card which the player desires. A straight is simply a sequence of next-ranked cards. A flush is all cards of any value of the same suit. A straight flush is a sequence of next-ranked cards of the same suit. Three of a kind is three identically ranked cards of three suits.

After the cards have been played and the payouts have been paid for the first stage of the round, each player has the option of determining whether he or she wishes to continue play for the second and third stages of the round. For those players who wish to terminate playing the round after the first stage, those players are allowed to withdraw the initial wagers for the second and third stages which have been placed in the wager enclosures 24 and 26. Those players who wish to continue playing the round after the first stage, must leave the initial wagers in the wager enclosing shapes 24 and 26. Some variations of the game may allow a player who wishes to continue to increase the amount of the initial wagers for the second and third stages of the round. However, players may not decrease the amount of the initial wagers for the second or third stages of the round, other than to cease play for those second and third stages of the round altogether. In addition, if any of the cards have been dealt face-down during the first stage of the round of play, those cards must be turned face-up for the second and third stages of the round of play.

Figure 4:
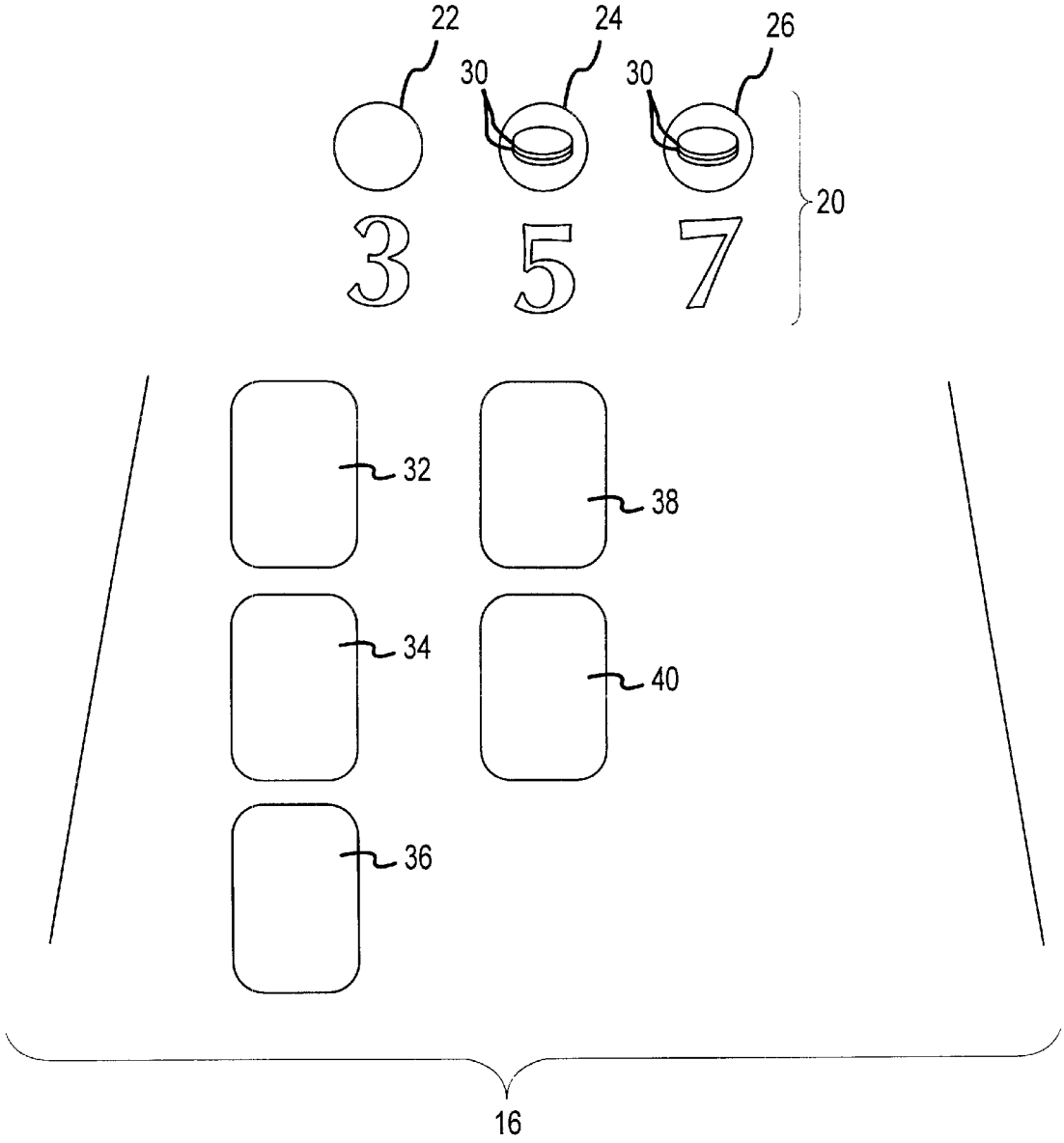
FIG. 4 is a plan view similar to FIG. 3, illustrating the play of cards during a second stage of playing a round of the game of the present invention.

The second stage of each round of play begins with the dealer dealing two additional cards 38 and 40, as shown in FIG. 4. The two additional cards 38 and 40 are dealt in each player's card play portion 16, generally in alignment with the second wager enclosure 24, thereby indicating the cards dealt during the second stage of the round. Preferably the cards 38 and 40 are dealt face-up, but variations of play may permit at least one of the cards 38 or 40 in the second stage of the round to be dealt face-down. The cards 32, 34 and 36 dealt in the first stage of the round plus the two cards 38 and 40 dealt in the second stage of the round constitutes the five card hand that the player plays during the second stage of the round.

The printed number five below the wager enclosure 24 indicates the denomination of card that is wild in the second stage of the round of play. Thus, if one of the cards 32, 34, 36, 38 or 40 is a five, any value may be substituted for that card. During the second stage of each round, a three card is no longer wild, because the three card was wild only during the first stage of the round. In other words, the card or cards which were wild in a previous stage of the round are no longer wild after the play of that stage has been completed. Using any wildcards and the other cards which are not wildcards that have been dealt to each player in the first and second stages of the game, each player who receives one of the winning hands of card combinations designated within the second column of the payout portion 28 (FIGS. 1 and 2) wins an amount established by his initial wager for the second stage and the odds designated within the payout portion 28 for the winning hand in the second-stage five-card hand. Those players who did not receive one of the hands designated in the payout portion 28 lose their initial wager for the second stage within the wager enclosure 24.

The winning hands of the five cards in the second stage of the round are indicated in the payout table 28 shown in FIG. 2 as a three of a kind, straight, flush, full house, four of a kind, straight flush and five of a kind. For the five card hand at the second stage of each round, the payout odds for three of a kind is 1 to 1, the payout odds for a straight is 5 to 1, the payout odds for a flush is 6 to 1, the payout odds for a full house is 8 to 1, the payout odds for four of a kind is 10 to 1, the payout odds for a straight flush is 60 to 1 and the payout odds for five of a kind is 100 to 1.

In the second stage of each round, a winning hand of a three of a kind, a four of a kind or a five of a kind is defined by three, four or five identically ranked cards of different suits. Since there are only four suits in a deck of cards, a five of a kind hand will require the presence of a wildcard. A straight, flush and straight flush winning five-card hand in the second stage of each round are defined in the same manner as described with respect to the first stage of the round, except that five cards are required in each hand rather than three cards. A full house five card winning hand in the second stage is defined by two cards having the same ranking and three cards having the same ranking which is different from the ranking of the two cards of that hand.

The second stage of the round is completed by each player with a winning hand receiving a payout from the dealer, and those players not having winning hands losing their initial wagers contained within the wager enclosure 24. The amount of the payout is based on the players initial wager for the second round placed in the wager enclosure 24 (FIG. 4), in the same manner as previously described. Any cards which were dealt face-down during the second stage of the round must be turned face-up before commencing the third stage of play of the round.

Figure 5:
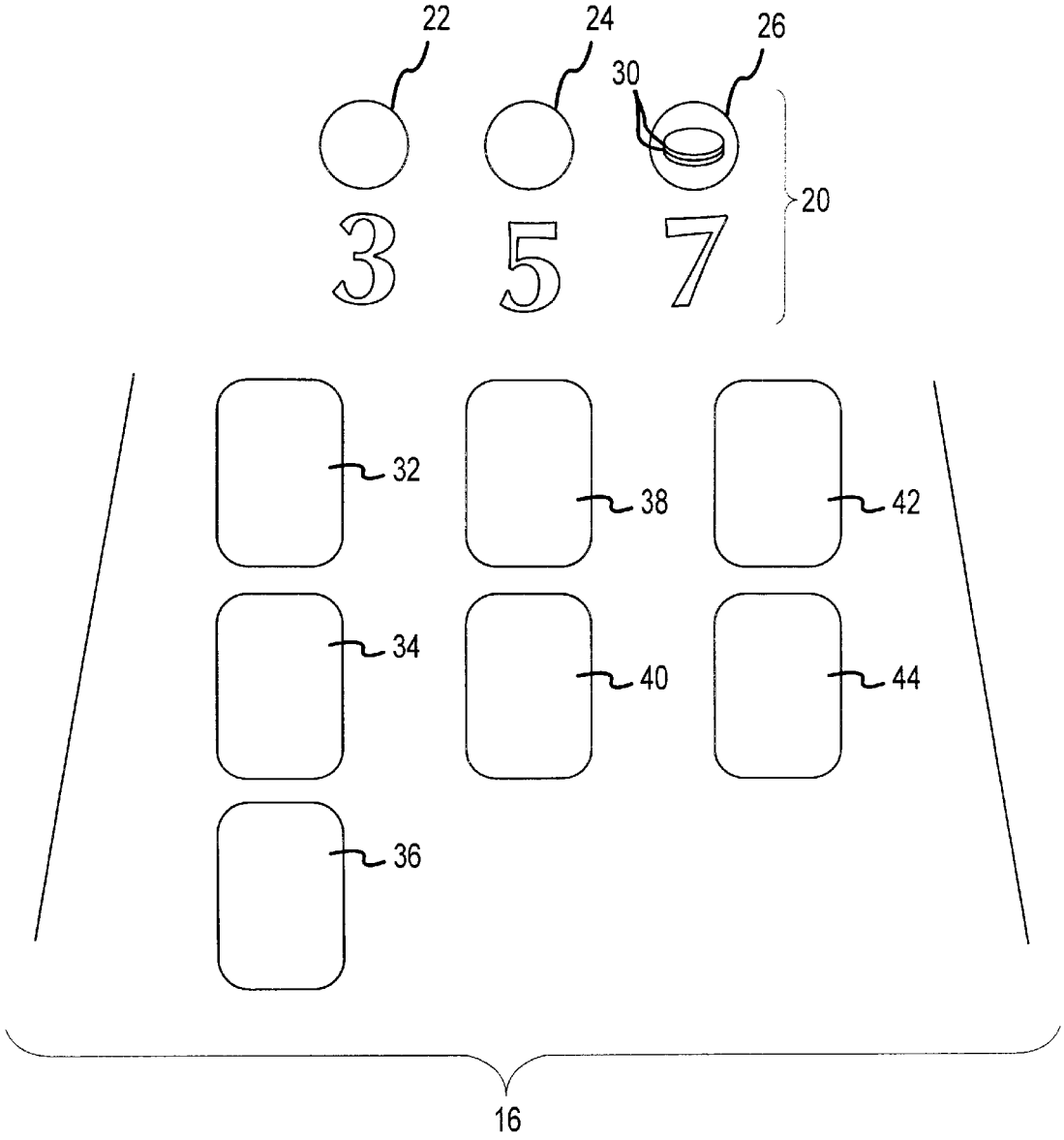
FIG. 5 is a plan view similar to FIGS. 3 and 4, illustrating the play of cards during a third stage of playing a round of the game of the present invention, and also illustrating the play which completes a round of the game of the present invention.

Before commencing the third stage of play, those players who wish to withdraw from playing the third stage of the round retrieve their initial wager from the wager enclosure 26. Those players who wish to continue are then dealt two additional cards 42 and 44, as shown in FIG. 5. The two additional cards 42 and 44 are dealt in alignment with the third wager enclosure 26, thereby indicating the cards dealt during the third stage of the round. Preferably the cards 42 and 44 are dealt face-up, but variations of play may permit at least one of the cards 42 and 44 to be dealt face-down. The cards 32, 34 and 36 dealt in the first stage of the round, plus the cards 38 and 40 dealt in the second stage of the round, plus the two cards 42 and 44 dealt in the third stage of the round constitute the seven card hand that the player plays during the third stage of the round.

The printed number seven below the wager enclosure 26 indicates the denomination of card that is wild in the third stage of the round of play. If one of the cards 32, 34, 36, 38, 40, 42 or 44 is a seven, any value may be substituted for that card. During the third stage of each round, the three card and the five card from the first and second stages of play are no longer wild, because the wildcards of previous stages are no longer wild after the previous stage of play has been completed. Using any wildcards and the other cards which are not wildcards that have been dealt to each player in the first, second and third stages of the round, each player who receives one of the hands designated within the third column of the payout portion 28 (FIGS. 1 and 2) wins an amount established by his initial wager for the third stage and the odds designated within the payout portion 28 for the third stage seven card winning hand. Those players who did not receive one of the winning hands designated in the payout portion 28 lose their initial wager for the third stage within the wager enclosure 26.

The winning seven-card hands in the third stage of the round are shown in FIG. 2 as a flush, full house, four of a kind, straight flush, five of a kind, six of a kind and seven of a kind. For the seven card hand at the third stage of each round, the payout odds for a flush is 2 to 1, the payout odds for a full house is 3 to 1, the payout odds for four of a kind is 4 to 1, the payout odds for a straight flush is 5 to 1, the payout odds for five of a kind is 25 to 1, the payout odds for six of a kind is 100 to 1 and the payout odds for seven of a kind is 1000 to 1.

In the third stage of the round, a winning hand of five of a kind, six of a kind or seven of a kind is defined by five, six or seven identically ranked cards, respectively. Since there are only four suits of cards in a deck, the five of a kind hand, six of a kind hand and seven of a kind hand will require the presence of one, two and three wildcards, respectively. A flush and straight flush winning seven-card hand in the third stage are defined in the same manner as described with respect to the second stage of the round, i.e. only five cards are required to form these winning hand card combinations even though seven cards form the hand of the third stage. A full house winning hand in the third stage is also defined identically as in the second stage of the round, i.e. by two cards having the same ranking and three cards having the same ranking which is different from the ranking of the other two cards of that winning hand card combination.

The third stage of the round is completed by each player with a winning hand receiving a payout from the dealer, and those players not having winning hands losing their initial wagers contained within the wager enclosure 26. The amount of the payout is based on the player's initial wager for the third round placed in the wager enclosure 26 (FIG. 5), in the same manner as previously described. After all three stages have been completed, the next round of play of the game commences.

The games offer a number of advantages to the players. First of all, the wildcards in each of the three stages of play are identical numerically to the number of cards played. In the first stage, a three card is the wildcard, and three cards are dealt in the first stage of play. In the second stage, a five card is wild and five cards are dealt for the second stage of play (three cards from the first stage plus two additional cards for the second stage). In the third stage, a seven card is wild and seven cards are dealt (three cards from the first stage plus two cards from the second stage plus an additional two cards for the third stage). The payout portion 28, which is printed prominently on the table top configuration 10, assists the player in knowing exactly the type of hands which might be constructed based on the cards dealt to the player.

Inexperienced players need not memorize the types of hands which are winning hands. Interest in the game is continued and promoted by the possibilities of winning at each stage of each round, or by withdrawing at the conclusion of each preceding stage before the next or last stage of each round. The odds change at each stage of the game, depending on the number of cards which have been dealt. Each winning hand has at least 1 to 1 payout odds, and most of the winning hands have greater payout odds, there is a higher level of excitement for the possibilities of winning compared to conventional poker where the odds remained fixed at 1 to 1 for most of the winning hands.

The staged play of each round of the game, the changing odds from the different hands of cards at each stage of the round, the changing wildcards at each stage, and the opportunity to withdraw or continue play at each stage all contribute to increased complexities and opportunities for serious, intentional, competitive players who gamble more for reasons of competition and excitement. On the other hand, the clear organization of stages of each round with the number of cards dealt in each stage being related directly to the wildcard, the printed information describing the winning hand card combinations at each stage, and printed information describing the payout odds at each stage, decreases the amount of concentration and mental effort required to simplify the playing of the game for those casual players who play the game more for entertainment. The increased amount of interest, intrigue, challenge, complexity and entertainment value attracts more players of all types and keeps the players engaged in the play of the game for a longer time, to the ultimate benefit of the casino. The added interest of an auxiliary or sideline incentive game is inherently obtained by the play at each stage of each round of the game, because each player retains a significant payout opportunity at each stage of each round of the game. The game offers the opportunity for the casino to extend the house odds and level of play within the context of a single, supervised and odds-controlled game, without using facilities to provide an auxiliary or sideline game that may be of little or no commercial value to the casino or gaming facility.

The poker game may be played in many interesting and somewhat more complex variations. The simple variation described above involves each player competing relative to the payout odds and not against other players. Some of the more complex versions of the game, a few of which are described below, involve competition among the players as well as competition relative to the game payout odds. The game thereby offers the opportunity for variations to maintain or increase interest in the game. The variations in the play of the game are relatively easy to implement, because all of the variations are played on the same table top configuration 10 (FIG. 1) using the same basic rules of play described above.

In one variation of the game, all of the cards are dealt face-down at each stage of the round. However, one less card is dealt to each of the players in that player's card play portion 16 (FIGS. 3–5), and instead one community card is dealt face-down by the dealer. The community card becomes part of each player's hand. Each player's hand becomes the basis for winning and losing the game of the present invention, and becomes the basis for a competitive poker hand between the players. Each player's hand of cards is thus applicable to both endeavors. However, because winning or losing according to the game of the present invention is determined by the poker hands shown in the payout portion, and some of those winning hand card combinations may also be applicable to determine winners and losers of competitive poker among the players, the single hand of cards to each player does not substantially increase the mental complexity required to play the two games simultaneously.

Before any of the face-down cards are turned face-up, each player must ante an amount equal to or greater than the initial wager contained in the wager enclosure 22 in order to participate in competitive poker among the players. After each player has anted, the community card is first turned face-up. Each player then has the opportunity to make a further competitive wager, which will require all of the other players to match that additional competitive wager in order to remain in the competitive poker game among the players. The player's cards are then turned face-up. The player's cards may be turned face-up in an orderly sequence which provides further opportunities for each player to increase the competitive wager in the competitive poker game among the players. Once all of the cards have been turned face-up, each player wins or loses the game of the present invention according to the payout odds printed in the payout portion 28 (FIG. 2) of the table top configuration, and each player wins or loses the competitive poker game between the players according to the value of the conventional poker hand of the players. Play continues in a similar manner through the second and third stages of the round. One community card is dealt face-down at each stage, and the players each receive one face-down card during the second and third stages of the round. Again, the community card becomes part of each players hand during the second and third stages of the round. In order for each player to stay in the game at the first, second and third stages, the players must ante and place competitive wagers equal to the highest ante and competitive wager of any other player.

Another variation of the game is played as described in the preceding paragraph, with the exception that the ante placed by the players to stay in the game at each stage of the round goes to the player having the highest ranking card hand in that stage of the round, and no further competitive betting beyond the ante is permitted.

Another variation is similar to the above described variations, except that the players also play competitively against the dealer. The dealer receives a hand of cards and there is no community card. Each player receives his or her own cards to form each hand at each stage of the round. In the first stage of the round, two of the three cards dealt to the dealer are dealt face-up, and the one remaining card to the dealer is dealt face-down. The dealer's cards must have a certain predetermined minimum value, for example a pair of sixes, for the round to proceed. If the dealer's hand does not qualify, the dealer pays each player a payout amount equal to the amount of the initial wager in the wager enclosure 22 (FIG. 3). If the dealer's hand qualifies, the players must ante an additional amount beyond the initial wager in the wager enclosure 22, if any player chooses to ante. After the ante by the players has concluded, the dealer and the players turn their face-down cards face-up. The dealer pays and collects on the basis of the poker hands of each player relative to the dealer's hand and the amount of each player's ante. The dealer also pays the players according to the payout schedule of the present game. Those players who do not have a winning hand of cards lose the amount of their initial wager. Play continues through the second and third rounds in a similar manner. To qualify for further play, the dealer's hand must continue to have an ever-increasing ranking with each stage of the round. The round of competitive poker between the dealer and the players ends at any stage where the dealer's hand fails to attain a qualifying value.

Figure 6:
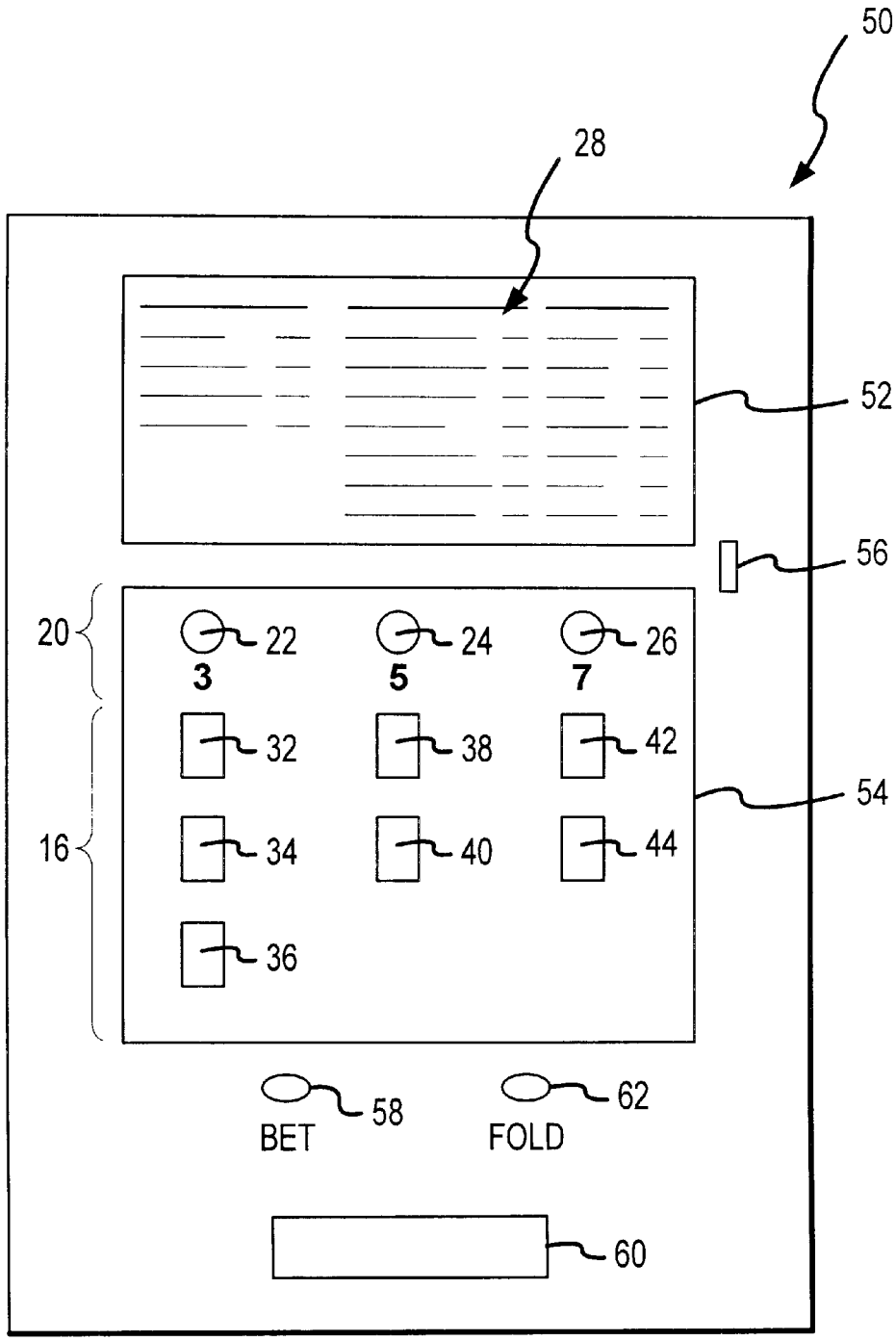
FIG. 6 is a simplified front view of an electronic or video gaming machine having displays and presentations forming a configuration with which to play the game of the present invention.

A further variation of the present game may be played on an electronic or video gaming machine 50, as shown in FIG. 6. The machine 50 includes an upper display 52 upon which information defining the payout portion 28 of the game is presented. The display 52 presents the information from the payout portion 28 as shown in FIG. 2. The machine 50 also includes another display 54 which serves to display the wager portion 20 and the cards dealt to each player in the card play portion 16. The wager enclosures 22, 24 and 26 for each stage of the round are displayed in a horizontal row (as shown) within the wager portion of the display 54. The wildcard for each stage of the round is displayed below each of the wager enclosures. A path-like column extends downward below each of the wager enclosures 22, 24 and 26, and it is into this column that the machine 50 places displays of the cards 32, 34, 36, 38, 40, 42 and 44 at the different stages of the round. The machine 50 includes a coin slot 56 into which the player must insert coins or tokens in order to make the initial wagers for each stage of the round of the game. An indication appears in the wager enclosures 22, 24 and 26 to show that the initial wagers have been placed.

After the wagers have been placed, the play of the first stage of the round is initiated by the player pressing a "bet" button 58 on the front of the machine 50. Conventional electronics (not shown) of the machine 50 randomly generate and display the three cards dealt to the player at the first stage of the round. The cards are generated by electronically simulating dealing from a single card deck or from a multiple-deck shoe. The three cards 32, 34 and 36 are displayed in a column below the wager enclosure 22, thereby indicating the card play during the first stage of the round. A winning hand card combination identified in the payout schedule 28 of the display 52 results in the machine 50 paying the player according to the payout schedule, the amount of the initial wager, and the payout odds. Payments are delivered to the player in a coin or token trough 60 of the machine 50. The player loses if he or she does not receive a winning hand card combination. If the player wishes to withdraw from playing further stages of the round, the player presses a "fold" button 62. Pressing the fold button 62 results in the machine 50 delivering the amount of the player's initial wager back to the player through the coin trough 60. If the player wishes to progress to the second stage of the round, the player presses the bet button 58. The game procedure outlined above occurs for the second stage of the round, and for the third stage of the round if the player again presses the bet button 58 at the conclusion of the second stage. In this manner, play of the game is implemented as a single-player, electronically controlled game.

The game of the present invention may also be implemented as a parlor game, using one or more game boards (not shown) to present the information of the payout schedule 28 and to establish the wagering portion 20 with its wager enclosures 22, 24 and 26 and the identification of the wildcards. One or more conventional card decks and an amount of chips, tokens or money are also required to play the parlor version of the game.

Many other variations of the present multi-stage poker game with variable wildcards and variable payouts at each stage of a round of the game will become apparent upon gaining a full appreciation for the aspects of the present invention.

Presently preferred embodiments of the invention and many of its improvements have been described with a degree of particularity. These descriptions are preferred examples of implementing the invention, and are not necessarily intended to limit the scope of the invention. The scope of the invention is defined by the following claims.

What is claimed is:

1. A method of playing a round of a poker game with at least one deck of cards having different suits of cards within the deck and having different rankings of cards within each suit, comprising:

dividing the round into a plurality of stages;

placing a wager for each stage;

dealing a hand of cards to each player at each stage;

forming part of the hand of cards of each player at each stage subsequent to the initial stage by the cards dealt to that player in each previous stage;

designating a different wildcard for each stage;

determining whether each player has a winning hand of cards at each stage by comparing the hand of cards including any wildcards held by each player to a schedule of winning card combinations applicable to that stage;

paying each winner at each stage according to an odds schedule applicable to each hand of winning card combinations at each stage; and changing at least some of the winning card combinations and the odds schedule for each winning card combination at each stage.

2. A method as defined in claim 1, further comprising:

designating as the wildcard a card having a numerical ranking equal to the number of cards forming the head of cards at each stage of each round.

3. A method as defined in claim 1, further comprising:

dividing each round into first, second and third stages;

dealing three cards to each player in the first stage of each round; and designating a three card as the wildcard for the first stage of each round.

4. A method as defined in claim 3, further comprising:

dealing two additional cards to each player in the second stage of each round to form a five-card hand of cards for each player in the second stage; and designating a five card as the wildcard for the second stage of each round.

5. A method as defined in claim 4, further comprising:

dealing two additional cards to each player in the third stage of each round to form a seven-card hand of cards for each player in the third stage; and designating a seven card as the wildcard for the third stage of each round.

6. A method as defined in claim 1, wherein at least one of the winning card combinations at each stage has an odds schedule of greater than 1 to 1.

7. A method as defined in claim 6, further comprising:

dealing at least one of the cards of each hand face-up.

8. A method as defined in claim 7, further comprising:

dealing all of the cards face-up in each hand to each player at each stage.

9. A method as defined in claim 6, further comprising:

dealing face-down at least one of the cards of each hand.

10. A method as defined in claim 9, further comprising:

initially dealing face-down all of the cards at each stage; and turning face-up all the cards dealt during that stage at the conclusion of that stage and before dealing additional cards in another hand in a subsequent stage.

11. A method as defined in claim 10, further comprising:

requiring each player to ante an additional wager after dealing face-down the cards at each stage and before the cards of any player are turned face-up as a requirement for continued play within that stage and within the round.

12. A method as defined in claim 11, further comprising:

dealing a community card during each stage which is part of the and of cards of each player at that stage.

13. A method as defined in claim 12, further comprising:

awarding the cumulative additional wager anted by each player at each round to the player having the highest-ranking winning poker hand among all the players playing in that round; and awarding the cumulative additional wager anted by each player separately from paying each winner at each stage according to the odds schedule applicable to each hand of winning card combinations at that stage.

14. A method as defined in claim 11, further comprising:

awarding the cumulative additional wager anted by the players at each stage to the player having the highest-ranking winning poker hand among all the players playing in that round; and awarding the cumulative additional wager anted by each player separately from paying each winner at each stage according to the odds schedule applicable to each hand of winning card combinations of each player at that stage.

15. A method as defined in claim 14, further comprising:

dealing a community card during each stage which is part of the hand of cards of each player at that stage.

16. A method as defined in claim 6, further comprising:

dealing a community card during each stage which is part of the hand of cards of each player at that stage.

17. A method as defined in claim 6, further comprising:

dealing a hand of cards to a dealer to make the dealer a player at each stage;

requiring the hand of cards of the dealer to achieve a predetermined minimal value in order to continue play of the round beyond that stage; and awarding each player a payment equal to the wager of the player if the hand of cards of the dealer at each stage fails to achieve the predetermined minimal value.

18. A method as defined in claim 17, further comprising:

awarding the payment to each player separately from paying each winner at each stage according to the odds schedule applicable to each hand of winning card combinations at that stage.

19. A method as defined in claim 6, further comprising:

requiring each player to place the wager for each stage before starting play of the round.

20. A method as defined in claim 19, further comprising:

permitting each player to withdraw the wager for each subsequent stage after completing play of a previous stage of the round.

21. A method as defined in claim 20, further comprising:

requiring each player to withdraw the wager for all subsequent stages if any wager is withdrawn after completing play of a stage of the round.

22. A method as defined in claim 1, performed using a game configuration which comprises:

a card play portion into which the cards of each hand at each stage of the round are played;

a wagering portion including a wager enclosure for each stage of the round and within which the wager for each stage is indicated before commencing that stage of the round; and a payout portion containing the schedule of winning card combinations at each stage of the round and a schedule of payout odds associated with each of the winning card combinations.

23. A method as defined in claim 22, wherein:

the wagering portion further comprises an identification of each wildcard at each stage of the round.

24. A method as defined in claim 22, wherein:

the wager enclosure for each stage of the round is located adjacent to the indication of each wildcard for each stage of the round.

25. A method as defined in claim 22, wherein the game configuration has a shape for use as a table top on a gaming table, a table top game configuration comprising:

a semicircular configuration having an outer circular edge and a straight edge intersecting the circular outer edge, the table top configuration further comprising:

a bank portion located adjacent to the straight edge and behind which the dealer is positioned; and wherein:

each card play portion is generally sector shaped and extends from the outer circular edge toward the bank portion.

26. A method as defined in claim 25, wherein:

one wagering portion is associated with each card play portion and is located in a position between the card play portion and the bank portion.

27. A method as defined in claim 26, wherein:

the payout portion is located between the wagering portion and the bank portion.

28. A method as defined in claim 25, wherein:

the wager enclosure and the indication of the wildcard for each stage are located relative to the card play portion to establish a path-like area of the card play portion extending from the wager enclosure and the indication of the wildcard toward the outer circular edge within which to place the cards dealt to the player in the stage of the round associated with the wager closure and the indication of the wildcard for that stage.

29. A method as defined in claim 22, wherein the game configuration is displayed on at least one display screen of an electronic gaming machine.

* * * * *